US010486895B2

(12) United States Patent
Stille

(10) Patent No.: US 10,486,895 B2
(45) Date of Patent: Nov. 26, 2019

(54) PORTABLE SAFETY DEVICE CONTAINER

(71) Applicant: Troy A. Stille, Mason City, IA (US)

(72) Inventor: Troy A. Stille, Mason City, IA (US)

(73) Assignee: Troy A. Stille, Mason City, IA (US)

( * ) Notice: Subject to any disclaimer, the term of this patent is extended or adjusted under 35 U.S.C. 154(b) by 259 days.

(21) Appl. No.: 14/853,366

(22) Filed: Sep. 14, 2015

(65) Prior Publication Data

US 2016/0016725 A1 Jan. 21, 2016

Related U.S. Application Data

(63) Continuation of application No. 14/200,095, filed on Mar. 7, 2014, now abandoned.

(60) Provisional application No. 61/782,709, filed on Mar. 14, 2013.

(51) Int. Cl.

| | |
|---|---|
| ***B65D 85/00*** | (2006.01) |
| ***B65D 1/40*** | (2006.01) |
| ***B25H 3/00*** | (2006.01) |
| ***A62C 13/78*** | (2006.01) |
| ***B65D 25/04*** | (2006.01) |

(52) U.S. Cl.

CPC ..... *B65D 85/70* (2013.01); *A62C 13/78* (2013.01); *B25H 3/006* (2013.01); *B65D 1/40* (2013.01); *B65D 25/04* (2013.01)

(58) Field of Classification Search

CPC ..... A62C 13/00; A62C 13/003; A62C 13/76; A62C 13/78; B65D 85/70; B65D 1/40; B65D 25/04; B25H 3/006

See application file for complete search history.

(56) References Cited

U.S. PATENT DOCUMENTS

| | | | | |
|---|---|---|---|---|
| 2,487,528 | A * | 11/1949 | Dawson | B65D 5/5035 206/317 |
| 2,781,897 | A * | 2/1957 | Dale | F41C 33/06 206/317 |
| 4,855,845 | A | 8/1989 | Thrush | |
| 5,009,222 | A | 4/1991 | Her | |
| 5,771,977 | A | 6/1998 | Schmidt | |
| 2012/0310184 | A1 | 12/2012 | Pedersen | |
| 2014/0090993 | A1* | 4/2014 | Mosley | A45C 13/02 206/223 |

OTHER PUBLICATIONS

Ecosafe SA; Portable Eye Wash Case with 1 bottle of 200 ml Eye wash; www.camlab.co.uk/portable-eye-wash-case-with-1-botle-of-200-ml-eye-wash-p137; Feb. 14, 2013, Camlab, UK.

* cited by examiner

*Primary Examiner* — Christopher S Kim
(74) *Attorney, Agent, or Firm* — Zarley Law Firm, PLC

(57) ABSTRACT

A safety device container that has a divider with a cut-out section disposed within the chamber of the container to immobilize and protect a safety device. The container having a first and second housing that when in a closed position the second housing engages a ledge of the first housing.

18 Claims, 3 Drawing Sheets

PORTABLE SAFETY DEVICE CONTAINER

CROSS REFERENCE TO RELATED APPLICATION

This is a Continuation Application of U.S. patent application Ser. No. 14/200,095 filed Mar. 7, 2014, which claims the benefit of U.S. Provisional Application No. 61/782,709 filed Mar. 14, 2013.

BACKGROUND OF THE INVENTION

This invention is directed toward a portable safety device container and more particularly to a portable container for a fire extinguisher and eye wash container.

Typically, when performing industrial work and maintenance, safety devices such as fire extinguishers, eye wash containers, and the like are carried by workers. Particularly, when working with wind energy, oil rigs, and off-road systems, the safety device can be dropped or damages such that the trigger mechanism is crushed and either discharges or becomes inoperable. To guard against this, a container is needed that not only protects the safety device, but also immobilizes the trigger mechanism.

An objective of the present invention is to provide a portable safety device container that protects the safety device from damage.

A further objective of the present invention is to provide a portable safety device container that prevents discharge upon impact.

A still further objective of the present invention is to provide a portable safety device container that provides easy access.

These and other objectives will be apparent to one of ordinary skill in the art based upon the following written description.

SUMMARY OF THE OF THE INVENTION

A safety device container that has a divider with a cut-out section disposed within the chamber of the container to immobilize and protect a safety device. The container having a first and second housing that when in a closed position the second housing engages a ledge of the first housing.

DETAILED DESCRIPTION

Figure 1:
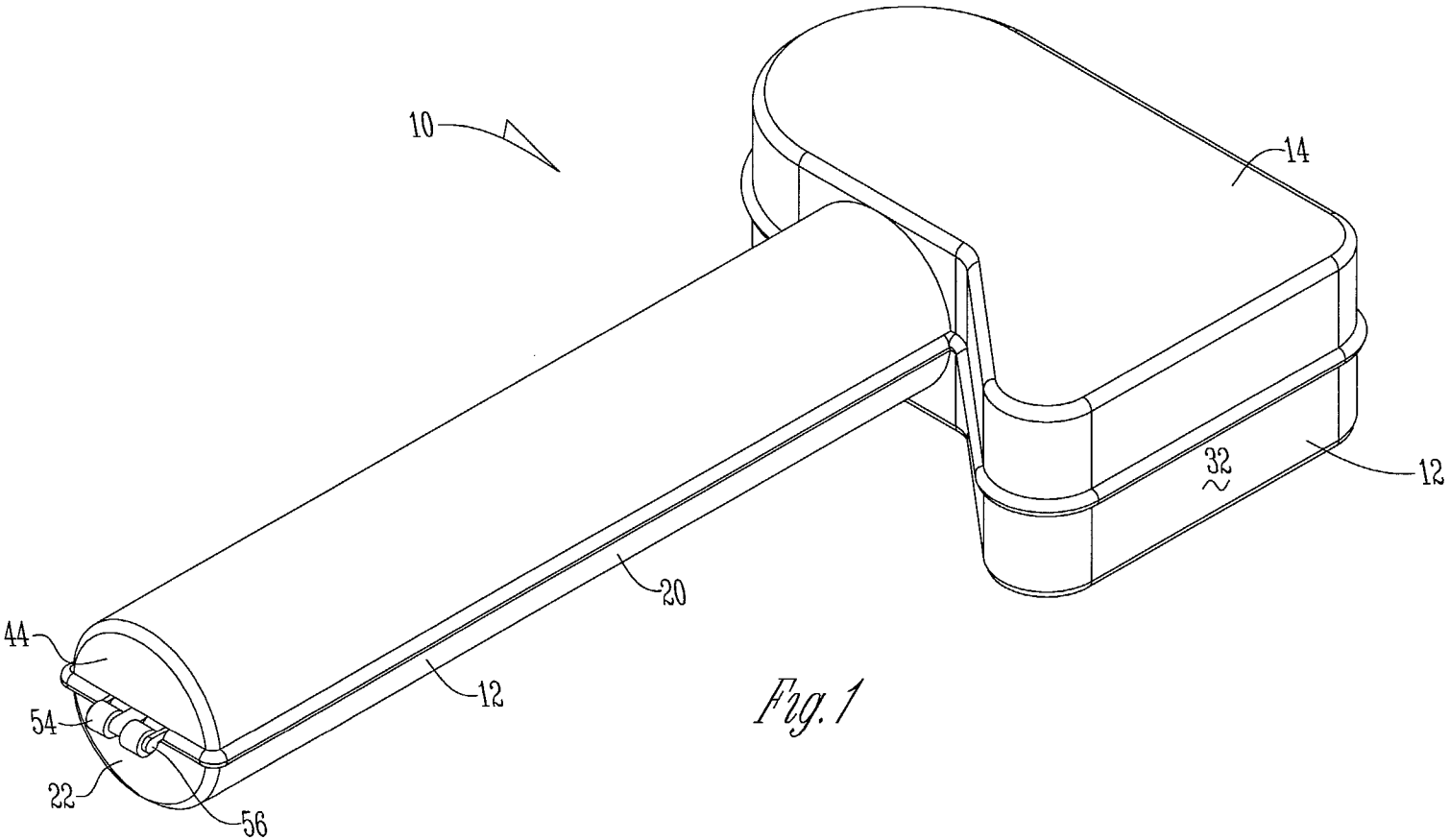
FIG. 1 is a perspective view of a safety device container.
Figure 2:
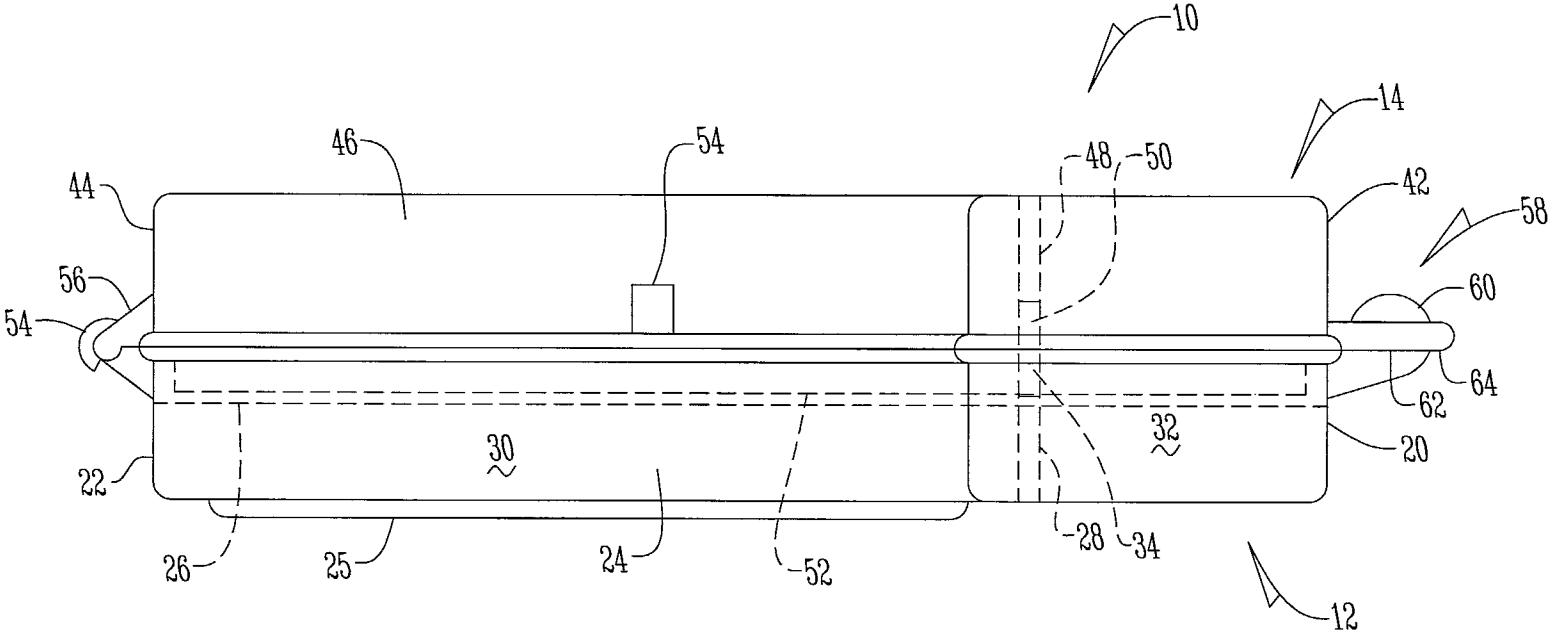
FIG. 2 is a side view of a safety device container.
Figure 3:
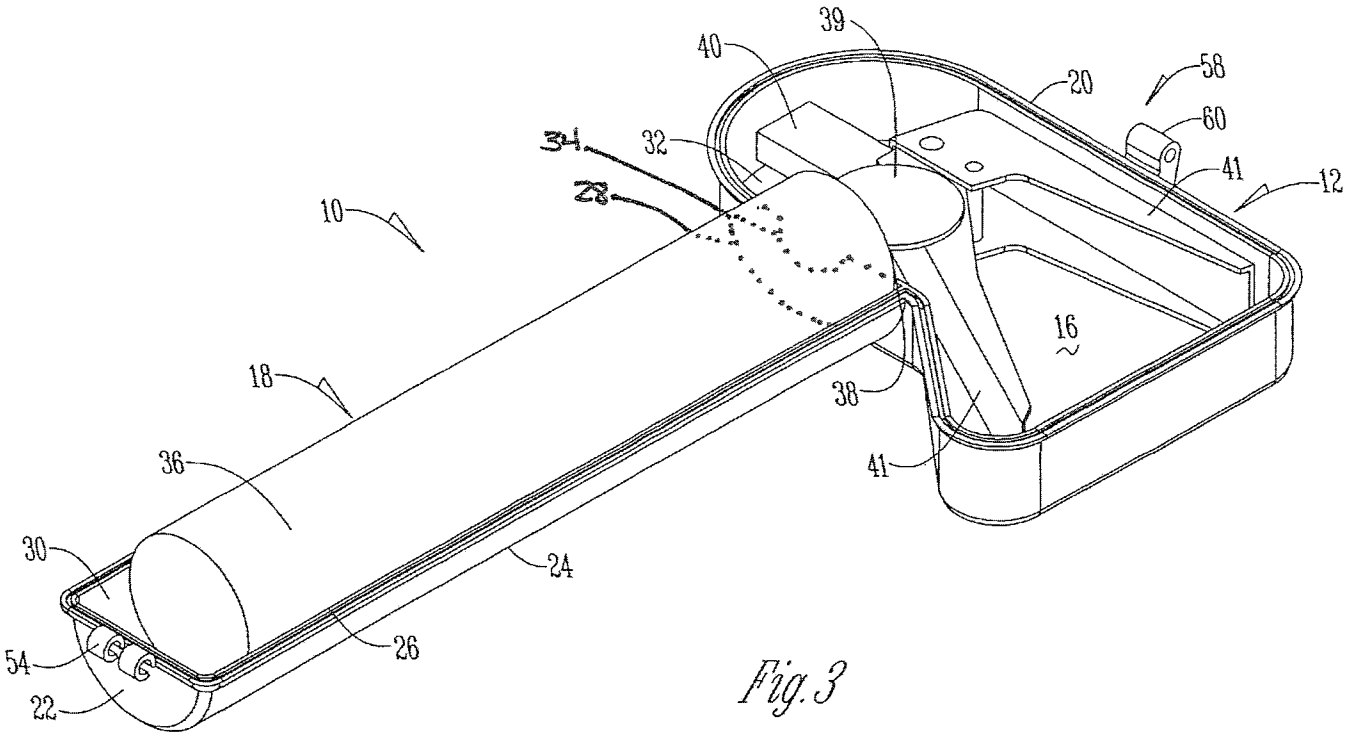
FIG. 3 is a top view of a safety device in a first housing of a safety device container.

Referring to the Figures the container 10 has a first housing member 12 and a second housing member 14 that fit together to form a hollow chamber 16 formed to receive a safety device 18 such as a fire extinguisher, and eye wash container or the like. The first housing member 12 has a first end 20 and a second end 22 with an elongated sidewall 24 there between that is preferably arcuate. In one embodiment, the sidewall 24 has a flat indented section 25 that can hold instructions or other materials. Extending inwardly around the sidewall 24 and ends 20 and 22 is a ledge 26.

Between ends 20 and 22, and within chamber 16 is a divider 28 that separates the first housing member 12 into a first section 30 and a second section 32. The divider 28 has a centrally located cut-out section 34 that preferably is arcuate. The first housing member 12 is formed to tightly receive the safety device 18. The divider 28 is positioned such that a body 36 of the safety device 18 is received within the first section 30, a neck 38 of the safety device 18 extends through the cut-out section 34 of the divider 28, and a head 39 of the safety device within the second section 32. In one embodiment, the safety device 18 has a head 39 having a nozzle 40 and actuating arms 41 that are received within the second section 32.

The second housing member 14 has a first end 42, a second end 44, and a sidewall 46 that extends there between formed to receive the opposite side of the safety device 18. Disposed within the chamber 16 of the second housing 14 is a second divider 48 that is positioned to align vertically with the first divider 28 when the container 10 is in a closed position. The second divider 48 has a cut-out section 50 that preferably is arcuate. The sidewall 46 and ends 42 and 44 of the second housing 14 are formed to fit tightly within the sidewall 24 and ends 20 and 22 of the first housing 12 such that the outer edge 52 of the second housing 14 engages the ledge 26 of the first housing 12.

The first housing 12 and second housing 14 are hingedly connected. In one embodiment, the first housing 12 has a plurality of flattened hooks 54 that extend outwardly from the second end 22. In another embodiment a single hook 54 can be used. The plurality of hooks 54 are received within slots 56 that extend outwardly from the second end 44 of the second housing 14.

At the first end 20 of the first housing 12 and the first end 42 of the second housing 14 is a releasable fastening member 58. In one embodiment, the fastening member 58 has a rounded portion 60 that extends outwardly from the first end 20 of the first housing 12 that snaps into a notch 62 that extends outwardly from the first end 42 of the second housing. In one embodiment the notch 62 has an elongated portion 64 to facilitate removal of the notch 62 from the rounded portion 60. In alternative embodiments the fastening member 54 is located anywhere on the exterior of the container 10 and is of any size, shape, or structure.

In operation, the safety device 18 is placed within chamber 16 of the first housing 12. The safety device 18 is received by the first housing 12 such that the body 36 of the safety device 18 is immobilized by the first section 30 and the neck 38 is immobilized by the cut-out section 34 of the divider 28. The head 39 of the safety device 18 is isolated in the second section 32 to prevent triggering the safety device. The second housing 14 is then fit within the first housing 12 such that outer edge 52 engages ledge 26. In this way the divider 48 of the second housing 14 is aligned with the divider 28 of the first housing 12 to secure the neck 38 of the safety device in the cut-out sections 32 and 52. Then the fastening member 58 is secured such that the container 10 is locked in a closed position.

What is claimed is:

1. A safety device container comprising:

a first housing configured to receive a safety device and having a first end, a second end, and a sidewall;

a second housing configured to receive the safety device and having a first end, a second end, and a sidewall hingedly connected to the first housing to form a chamber;

a divider positioned within the chamber having a cut-out section that divides the chamber into a first section configured to receive a body of the safety device and a second section configured to receive a head of the safety device, such that the safety device is immobilized when the safety device container is in a closed position; and the safety device positioned within the chamber, wherein the safety device is a fire extinguisher.

2. The safety device container of claim 1 further comprising a ledge extending inwardly around the sidewall, first end, and second end of the first housing.

3. The safety device container of claim 1 wherein the second housing is formed to fit within the first housing such that the second housing engages the ledge of the first housing.

4. The safety device container of claim 1 further comprising the sidewall of the first housing having a flat indented section, wherein the sidewall is otherwise arcuate.

5. The safety device container of claim 1 further comprising a releasable connecting member attached to the first end of the first housing member and the first end of the second housing member.

6. The safety device container of claim 1 wherein when the safety device is placed within the container a neck of the safety device is immobilized within the cut-out.

7. The safety device container of claim 1 wherein the cut-out section receives a neck of the safety device.

8. The safety device container of claim 1 further comprising a plurality of flattened hooks extending outwardly from the second end of the first housing that are received in a plurality of slots that extend outwardly from the second end of the second housing to hingedly connect the first housing and the second housing.

9. The safety device container of claim 1 further comprising the head having a nozzle and actuating arms.

10. A safety device container comprising:

a first housing having a first end, a second end, and a sidewall;

a second housing having a first end, a second end, and a sidewall connected to the first housing to form a chamber; and a safety device received within the chamber, wherein the first housing and second housing are formed in the shape of the safety device to receive the safety device.

11. The safety device container of claim 10 wherein the safety device is a fire extinguisher.

12. The safety device container of claim 10 wherein the sidewall of the first housing is arcuate.

13. The safety device container of claim 12 wherein the first housing and second housing are hingedly connected at the second end of the first housing and the second end of the second housing.

14. A safety device container comprising:

a first housing configured to receive a safety device and having a first end, a second end, and a sidewall;

a first divider having a cut-out section positioned within the first housing to divide the first housing into a first section and a second section;

a second housing configured to receive the safety device and having a first end, a second end, and a sidewall connected to the first housing to form a chamber;

a second divider having a cut-out section positioned within the second housing to divide the second housing into a first section and a second section;

a safety device positioned within the chamber such that a neck of the safety device is received within the cut-out section of the first divider and the second divider to immobilize the safety device;

wherein the first housing and second housing are formed to tightly fit around the safety device; and wherein the safety device is a fire extinguisher.

15. The safety device container of claim 14 wherein the cut-out of the first divider is centrally located.

16. The safety device container of claim 14 wherein when the first housing and the second housing are in a closed position the first divider and the second divider are in vertical alignment.

17. The safety device container of claim 14 further comprising a rounded portion extending outwardly from the first end of the first housing that is received into a notch extending outwardly from the first end of the second housing.

18. The safety device container of claim 17 further comprising the notch having an elongated portion configured to facilitate removal of the notch from the rounded portion.

* * * * *